US006725555B1

(12) United States Patent
Moore

(10) Patent No.: US 6,725,555 B1
(45) Date of Patent: Apr. 27, 2004

(54) PIVOTING RAFTER SQUARE

(76) Inventor: Darren S Moore, 109 Ocean Ave., Center Moriches, NY (US) 11934

( * ) Notice: Subject to any disclaimer, the term of this patent is extended or adjusted under 35 U.S.C. 154(b) by 0 days.

(21) Appl. No.: 10/351,844

(22) Filed: Jan. 27, 2003

(51) Int. Cl.[7] ..... B43L 7/12
(52) U.S. Cl. ..... 33/423; 33/465
(58) Field of Search ..... 33/1 N, 417, 418, 33/420, 421, 423, 424, 465, 471

(56) References Cited

U.S. PATENT DOCUMENTS

| | | | | | |
|---|---|---|---|---|---|
| 42,230 | A | * | 4/1864 | Shelley | 33/418 |
| 330,799 | A | | 11/1885 | Orendorff | |
| 359,372 | A | | 3/1887 | Warnock | |
| 485,456 | A | * | 11/1892 | Cook | 33/423 |
| 518,103 | A | | 4/1894 | Hodge | |
| 743,900 | A | | 11/1903 | Mahan | |
| 928,569 | A | | 7/1909 | Williams | |
| 1,159,483 | A | * | 11/1915 | Ernest | 33/423 |
| 1,191,008 | A | | 11/1916 | Laakkonen | |
| 1,453,625 | A | | 5/1923 | Johnson | |
| 1,483,761 | A | * | 2/1924 | Youngblood | 33/423 |
| 1,521,980 | A | * | 1/1925 | Zook | 33/423 |
| 1,834,389 | A | * | 12/1931 | Drescher | 33/418 |
| 1,913,919 | A | | 6/1933 | Dion | |
| 2,251,208 | A | * | 7/1941 | Sigmon | 33/423 |
| 2,504,244 | A | * | 4/1950 | Barclay | 33/420 |
| 2,726,452 | A | | 12/1955 | Maupin | |
| 4,208,804 | A | * | 6/1980 | Lundin | 33/418 |
| 4,712,307 | A | | 12/1987 | Kish | |
| 5,446,969 | A | * | 9/1995 | Terenzoni | 33/421 |
| 5,452,522 | A | * | 9/1995 | Kook et al. | 33/418 |
| 5,539,991 | A | * | 7/1996 | Harrison | 33/471 |
| 6,122,834 | A | | 9/2000 | Rester | |
| 6,330,752 | B1 | | 12/2001 | Ellum | |

* cited by examiner

*Primary Examiner*—G. Bradley Bennett
(74) *Attorney, Agent, or Firm*—Michael I. Kroll

(57) ABSTRACT

The present invention 10 discloses a rafter square 18 having a pivotal indicator arm 14 and pivotal indicator guide 16. The pivotal arm 14 and guide 16 are detachable from the rafter square portion 18 by unscrewing the thumbscrew 20 that secures the device to its pivotal point 22 located on the heel portion of the right angle square 18. A wing nut 24 is also removable and when in use allows the indicator arm 14 to slide along a track 26 and point to indication markings 28 along the tracks surface. Also provided are a ring bearing 38 and wing nut retainer 30. Located at the distal end of the indicator guide 16 is a storage port 40 with an end cap 42. The storage port 40 can hold the removed wing nut 24 and thumbscrew 20 when the arm 14 is removed. Within the storage port 14 a guide chart 44 can also be stored and used for reference.

11 Claims, 12 Drawing Sheets

44

| RISE | COMMON RAFTERS | HIP-VALLEY RAFTERS |
|---|---|---|
| 1 | 12.O4" | 17.00" |
| 2 | 12.16" | 17.09" |
| 3 | 12.37" | 17.23" |
| 4 | 12.65" | 17.44" |
| 5 | 13" | 17.69" |
| 6 | 13.42" | 18.00" |
| 7 | 13.89" | 18.36" |
| 8 | 14.42" | 18.76" |
| 9 | 15.00" | 19.21" |
| 10 | 15.62" | 19.70" |
| 11 | 16.28" | 20.22" |
| 12 | 16.97" | 20.78" |
| 13 | 17.69" | 21.38" |
| 14 | 18.44" | 22.00" |
| 15 | 19.21" | 22.65" |
| 16 | 20.00" | 23.32" |
| 17 | 20.81" | 24.02" |
| 18 | 21.63" | 24.74" |

FIG. 9

44

| RISE | 16" SPACING | 24" SPACING |
|---|---|---|
| 1 | 1'-4' 1/16" | 2' 1/8" |
| 2 | 1' 4 1/4" | 2' 3/8" |
| 3 | 1' 4 1/2" | 2' 3/4" |
| 4 | 1' 4 7/8" | 2' 1 3/8" |
| 5 | 1' 5 3/8" | 2' 2" |
| 6 | 1' 5 7/8" | 2' 2 7/8" |
| 7 | 1' 6 1/2" | 2' 3 7/8" |
| 8 | 1' 7 1/4" | 2' 4 7/8" |
| 9 | 1' 8" | 2' 6" |
| 10 | 1' 8 7/8" | 2' 7 1/4" |
| 11 | 1' 9 3/4" | 2' 8 5/8" |
| 12 | 1' 10 5/8" | 2' 10" |
| 13 | 1' 11 5/8" | 2' 11 3/8" |
| 14 | 2' 1/2" | 3' 7/8" |
| 15 | 2' 1 5/8" | 3' 2 3/8" |
| 16 | 2' 2 5/8" | 3' 4" |
| 17 | 2' 3 3/4" | 3' 5 5/8" |
| 18 | 2' 4 7/8" | 3' 7 1/4" |
| 19 | 2' 6" | 3' 9" |
| 20 | 2' 7 1/8" | 3' 10 5/8" |
| 21 | 2' 8 1/4" | 4' 3/8" |
| 22 | 2'9 3/8" | 4' 2 1/8" |
| 23 | 2' 10 5/8" | 4' 3 7/8" |
| 24 | 2' 11 3/4" | 4' 5 5/8" |
| 26 | 3' 2 1/4" | 4' 9 3/8" |
| 28 | 3' 4 1/2" | 5' 7/8" |
| 30 | 3' 7" | 5' 4 5/8" |

FIG. 10

44

| PITCH 1 | PITCH 2 | PLUMB CUT | SIDE ANGLE 1 | SIDE ANGLE 2 | PITCH 1 | PITCH 2 | PLUMB CUT | SIDE ANGLE 1 | SIDE ANGLE 2 |
|---|---|---|---|---|---|---|---|---|---|
| 1 | 2 | 4 1/4 | 63 | 27 | 6 | 10 | 22 1/2" | 59 | 34 |
| 1 | 3 | 4 1/2 | 72 | 19 | 6 | 11 | 23 1/2" | 61 | 29 |
| 1 | 4 | 4 1/2 | 76 | 14 | 6 | 12 | 24 | 63 | 27 |
| 1 | 5 | 4 3/4 | 79 | 12 | 7 | 8 | 24 | 49 | 41 |
| 1 | 6 | 4 3/4 | 81 | 10 | 7 | 9 | 24 1/2' | 52 | 38 |
| 1 | 7 | 4 3/4 | 82 | 8 | 7 | 10 | 25 1/2" | 55 | 33 |
| 1 | 8 | 4 3/4 | 93 | 7 | 7 | 11 | 26 1/2" | 58 | 32 |
| 1 | 9 | 4 3/4 | 94 | 6 | 7 | 12 | 26 1/2" | 60 | 30 |
| 1 | 10 | 4 3/4 | 94 | 6 | 8 | 9 | 26 1/2" | 48 | 42 |
| 1 | 11 | 4 3/4 | 95 | 5 | 8 | 10 | 27 1/2" | 51 | 39 |
| 1 | 12 | 4 3/4 | 95 | 5 | 8 | 11 | 28 | 54 | 36 |
| 2 | 3 | 8 | 56 | 34 | 8 | 12 | 29 | 56 | 34 |
| 2 | 4 | 8 | 63 | 27 | 9 | 10 | 29 | 48 | 42 |
| 2 | 5 | 9 | 68 | 22 | 9 | 11 | 30 | 51 | 39 |
| 2 | 6 | 9 | 72 | 18 | 9 | 12 | 31 | 53 | 37 |
| 2 | 7 | 9 | 76 | 14 | 10 | 11 | 31 1/2" | 48 | 42 |
| 2 | 8 | 9 | 77 | 13 | 10 | 12 | 32 1/2" | 50 | 40 |
| 2 | 9 | 9 | 79 | 11 | 11 | 12 | 35 | 47 | 43 |
| 2 | 10 | 9 | 80 | 10 | | | | | |
| 2 | 11 | 9 | 81 | 9 | | | | | |
| 2 | 12 | 9 1/2 | 84 | 6 | | | | | |
| 3 | 4 | 11 | 53 | 37 | | | | | |
| 3 | 5 | 12 | 59 | 31 | | | | | |
| 3 | 6 | 12 1/2 | 63 | 27 | | | | | |
| 3 | 7 | 13 | 67 | 23 | | | | | |
| 3 | 8 | 13 | 69 | 21 | | | | | |
| 3 | 9 | 13 1/2 | 72 | 18 | | | | | |
| 3 | 10 | 13 1/2 | 73 | 17 | | | | | |
| 3 | 11 | 13 1/2 | 75 | 15 | | | | | |
| 3 | 12 | 13 1/2 | 76 | 14 | | | | | |

FIG. 11

44

| PITCH 1 | PITCH 2 | PLUMB CUT | SIDE ANGLE 1 | SIDE ANGLE 2 |
|---|---|---|---|---|
| 4 | 5 | 14 1/2 | 51 | 39 |
| 4 | 6 | 15 1/2 | 55 | 34 |
| 4 | 7 | 16 | 60 | 30 |
| 4 | 8 | 16 1/2 | 63 | 27 |
| 4 | 9 | 17 | 66 | 24 |
| 4 | 10 | 17 | 68 | 22 |
| 4 | 11 | 17 | 70 | 20 |
| 4 | 12 | 17 | 72 | 18 |
| 5 | 6 | 17 | 50 | 40 |
| 5 | 7 | 18 | 54 | 36 |
| 5 | 8 | 19 1/2 | 58 | 32 |
| 5 | 9 | 20 | 60 | 30 |
| 5 | 10 | 20 1/2 | | 27 |
| 5 | 11 | 20 1/2 | 75 | 25 |
| 5 | 12 | 20 1/2 | 67 | 23 |
| 6 | 7 | 20 1/2 | 49 | 41 |
| 6 | 8 | 22 | 53 | 37 |
| 6 | 9 | 22 1/2 | 56 | 34 |

FIG. 12

PIVOTING RAFTER SQUARE

BACKGROUND OF THE INVENTION

1. Field of the Invention

The present invention relates generally to squaring tools and, more specifically, to a rafter square having a pivoting guide member and related locking means that will allow the user to selectively position the square at the appropriate angle required for the cut as determined by indicia thereon that is used to calculate the angles accordingly. Furthermore, there is a hollow storage compartment for protectively storing other required charts that may be needed for complex calculations that are infrequently used.

2. Description of the Prior Art

There are other squaring tools. Typical of these is U.S. Pat. No. 330,799 issued to G. B. Orendorff on Nov. 17, 1885.

Another patent was issued to D. W. Warnock on Mar. 15, 1887 as U.S. Pat. No. 359,372. Yet another U.S. Pat. No. 518,103 was issued to L. M. Hodge on Apr. 10, 1894 and still yet another was issued on Nov. 10, 1903 to W. B. Mahan as U.S. Pat. No. 743,900.

Another patent was issued to E. A. Williams on Jul. 20, 1909 as U.S. Pat. No. 928,569. Yet another U.S. Pat. No. 1,191,008 was issued to E. Laakkonen on Jul. 11, 1916 and still yet another was issued to R. H. Johnson on May 1, 1923 as U.S. Pat. No. 1,453,625 and I. Dion was issued U.S. Pat. No. 1,913,919 on Jun. 13, 1933. U.S. Pat. No. 2,251,208 was issued on Jul. 29, 1941 to D. L. Sigmon and on Dec. 13, 1955 L. E. Maupin was issued U.S. Pat. No. 2,726,452. K. E. Kish was issued U.S. Pat. No. 4,712,307 on Dec. 15, 1987. Ellam was issued U.S. Pat. No. 6,330,752 on Dec. 18, 2001 and on Sep. 26, 1995 Kook et al. was issued U.S. Pat. No. 5,452,522. G. S. Rester was issued U. S. Pat. No. 6,122,834 on Sep. 26, 2000.

U.S. Pat. No. 330,799

Inventor: George B. Orendorff

Issued: Nov. 17, 1885

A protractor, A, having an arm, B, and center, C, combined with a movable arm, D, at right angle and provided with the curved indicator-arm d, substantially as shown, for the purpose specified.

U.S. Pat. No. 359,372

Inventor: David Wesley Warnock

Issued: Mar. 15, 1887

The combination of the body A, having slots a, c, the blade B, provided with the beveled shoulder a, the slotted bar C, provided with the pivot b, substantially as herein shown and described.

U.S. Pat. No. 518,103

Inventor: Leonard M. Hodge

Issued: Apr. 10, 1894

In an instrument of the class described, a scale-plate having an integral plumb-cut member, and a bottom-cut member, and having on one side graduations showing the relative dimensions of parts for common rafters of different rises and runs, and having on the other side, graduations showing the relative dimensions of octagon rafters for different rises and runs, in combination with a main frame, a blade slidable on said main frame and having a changeable connection with said scale plate, as set forth.

U.S. Pat. No. 743,900

Inventor: William B. Mahan

Issued: Nov. 10, 1903

In an instrument of the class described, a scale plate having an integral plumb end member, and bottom-cut member, and having an integral bottom cut member, and having on one side graduations showing the relative dimensions of parts for common rafters of different rises and runs, having on the other side, graduations showing the relative dimensions of octagon rafters for different rises and runs, in combination with a main frame, a blade slidable on said main frame having changeable connection with said scale plate.

U.S. Pat. No. 928,569

Inventor: Edmund A. Williams

Issued: Jul. 20, 1909

A device of the character described, comprising a longitudinally slotted handle, a square pivotally attached at its outer corner to one corner of said handle, one blade of said square having diagonal lines adjacent its inner edge and adapted to lie in said slot, and means to secure said handle and adjusted position.

U.S. Pat. No. 1,191 008

Inventor: Ephraim Laakkonen

Issued: Jul. 11, 1916

A carpenter's square comprising a blade and a tongue on the inner edge thereof, a notched plate mounted in the curved edge of the quadrant, a forked setting arm pivoted to the square and embracing the quadrant, and a pivot latch mounted on the setting arm and selectively engageable in the notches of the plate to secure the setting arm in a desired adjustment.

U.S. Pat. No. 1,453,625

Inventor: Robert H. Johnson

Issued: May 1, 1923

A tool comprising a butt, a blade pivoted to the butt, said butt having a notch in one edge thereof, curved parts at each end of the notch arranged to lie at opposite sides of one edge of the blade, when said blade is disposed at right angles to the butt.

U.S. Pat. No. 1,913,919

Inventor: Isaie Dion

Issued: Jun. 13, 1933

A square comprising blade and tongue members pivoted to each other at their meeting ends, said blade member being formed with a recess into which the tongue member may be received as a whole when it is swung into a folded position, a screw carried by the blade member adapted to engage the end of the tongue remote from the pivot when the members are closed upon each other for securing them together, one of the members having an arcuate slot concentric with the pivot, a screw passing through said slot and engaging the other member of the square so as to fasten the members in any desired angular relationship with respect to each other, and said member with the arcuate slot being countersunk at one end of said slot to afford a deeper seat for engagement with the head of said screw so that the members may be positively locked when they swung to right angles with respect to each other.

U.S. Pat. No. 2,251,208

Inventor: Dallas L. Sigmon

Issued: Jul. 29, 1941

The combination with a square having body and tongue members, of a radial arm having scale markings theron substantially as shown and described, a quadrant shaped arm pivotally attached to the tongue member aforesaid, and the said quadrant shaped arm having provided a straight outer edge adapted to form with the radial arm the angle of the side cut for hip, valley and jack rafters of a gable roof when the body member and radial arm aforementioned are adjusted to the angle of inclination of the said rafters, and means provided on said quadrant shaped arm for registering on the scale markings provided on the radial arm aforesaid.

U.S. Pat. No. 2,726,452

Inventor: Leslie E. Maupin

Issued: Dec. 13, 1955

A device of the class described, a quadrant plate having a level ruling edge, a plumb ruling edge and an arcuate edge, a pivot pin on said plate with the axis thereof in alignment with said level ruling edge and at the geometric center of said arcuate edge, a pivot pin on said plate with the axis thereof in alignment with said axis of the pivot pin, arcuate scales and indicia on said plate with said axis of said pivot pin as the geometric center thereof, cooperating indicia on said bar, said bar consisting of a pair of similar strips spanning and adapted to traverse the opposite sides of the quadrant plate, both ends of each of said strips projecting beyond the peripheral edge of said plate, spacing elements fixed between the adjacent projecting ends, a scale arm pivotally mounted on said quadrant plate between said pivot pin for aid bar and the plumb edge of said plate and adapted to be extended outwardly at right angles to said plumb edge.

U.S. Pat. No. 4,712,307

Inventor: Karl E. Kish

Issued: Dec. 15, 1987

The rafter angle device includes a body in the form of a generally U-shaped plate of metal or the like having a horizontal base and spaced first and second vertical arms at opposite ends thereof A third arm is pivotally connected to the plate at about the end of the base bearing the first arm and extends beyond the second arm. The third arm may releasably receive and is releasably securable to at least one of the first and second arms in any position between about horizontal and vertical, as by a locking nut. The first arm has a generally triangular support portion secured to the base about halfway along the length thereof and defining a spaced pair of curved slots, with angle, hip rafter valve and common jack plumb cut indicia disposed along the perimeter of the slots thereof The support portion may also bear door sill and window sill indicia, while at least one margin of each of the three arms and base bear linear indicia in fractions of an inch. The third arm has a bubble level in a cage so as to be releasable from all major angles. The base is adapted to measure roof rafter angles and also serves as a U-square U.S. Pat. No. 6,330,752

Inventor: Albert F. Ellam

Issued: Dec. 18, 2001

An adjustable squaring tool for measuring and marking angles includes a pivot arm pivotally coupled between first and second sections of a main member. The pivot arm having a graduated arcuate measurement arm extending from the pivot arm through a channel in the main member. The pivot arm having a cylinder coupled to an end of the pivot arm. The main member includes a drum passing through the cylinder. The cylinder has a plurality of radially spaced apertures corresponding to the gradations of the measurement arm. The drum includes at least one spring biased bearing positioned for engaging apertures in the cylinder as the cylinder rotates around the drum. A locking assembly is provided for clamping the pivot arm between the first and second sections of the main member to lock the pivot arm relative to the main member. In an embodiment the apertures are spaced for adjusting the tool in one degree increments between 10 degrees and 90 degrees.

U.S. Pat. No. 5,452,522

Inventor: Donald D. Kook et al.

Issued: Sep. 26, 1995

A framing layout tool includes two squares each with two legs or blades 90 degree apart. The squares are pivotally attached at their vertices by a pivot pin including a knurled locking nut. One of the squares includes a longitudinally aligned electronic plumb and level indicator on one of the legs. The other leg of that square includes indicia on a leg reference edge for indicating rise-over-run integers representative of the angular separation of that other leg and a leg of the other square. Indicia indicating the actual angle between such legs is also contained on an opposite reference edge of that other leg. The layout tool has particular utility for accurately marking the location of a plumb cut, seat cuts and.a ridge cut in roof rafters where the blade of the second square is placed on an inclined rafter and oriented with the electronic level in a vertical plumb position. When a visual and auditory indication of exact plumb is obtained the clamping nut is locked. Using the locked device, the angle of inclination can be read and locked unit used to scribe cutting lines on a rafter to have the same inclination as the first measured rafter.

U.S. Pat. No. 6,122,834

Inventor: Glenn Steven Rester

Issued: Sep. 26, 2002

A combination speed and framing square includes first and second legs joined to form a right angle. The first and second legs are substantially longer than those found on a typical framing square allowing higher pitch roof rafters to be sequentially marked in increments of two feet. A third leg is attached to the first and second legs forming the hypotenuse of a right triangle with the first and second legs. The third leg has an elongated marking aperture with hip and valley and common rafter marking indicia on opposing sides thereof as well as incremental angular indicia adjacent its outer edge as with a typical speed square. Level indicators such as bubble levels are disposed on the first and second legs. At each end of the first leg and at a distal end of the second leg is an integral elongated slot each dimensioned to removably receive a rolling measuring device with a digital distance indication means on the exterior thereof Accordingly, a distance may be quickly and easily measured by rolling the device along a surface and visually reading the display device.

While these squaring devices may be suitable for the purposes for which they were designed, they would not be as suitable for the purposes of the present invention, as hereinafter described.

SUMMARY OF THE PRESENT INVENTION

The present invention discloses a rafter square having a pivotal indicator arm and pivotal indicator guide. The pivotal arm and guide are detachable from the rafter square portion by unscrewing the thumbscrew that secures the device.to its pivotal port located on the heel portion of the right angle square. A wing nut is also removable and when in use allows the indicator arm to slide along a track and point to indication markings along the tracks surface. Located at the distal end of the indicator guide is a storage port. The storage port can hold the removed wing nut and thumbscrew when the arm is removed. Within the storage port a guide chart can also be stored and used for reference.

A primary object of the present invention is to provide a pivoting rafter square for laying out rafters and calculating the length and angles of the required cuts.

Another object of the present invention is to provide a pivoting rafter square having a detachable guide similar to a tee-square that is pivotally connected to the heel portion of the right angle square and may be locked into the desired position by the user by means of a locking mechanism such as a thumbscrew.

Yet another object of the present invention is to provide a pivoting rafter square having indicia located thereon denoting the angles and degrees for quickly and accurately determining the angle of each situational cut for common rafters and hip rafters as well as irregular hips and valleys.

Still another object of the present invention is to provide a pivoting rafter square that will eliminate the need of having to repeatedly align increments on each side of the square for one workpiece for plumb cuts, seat cuts and overhangs.

Another object of the present invention is to provide a pivoting rafter square having a guide member to press to the workpiece rather than against rough edges, knots and other irregularities in the plane of the workpiece which often tend to compromise the accuracy of conventional squares.

Yet another object of the present invention is to provide a pivoting rafter square that can be used separately as a tee square or rafter square.

Still yet another object of the present invention is to provide a pivoting rafter square that can be used as a protractor.

Another object of the present invention is to provide a pivoting rafter square that can be used as a bevel square for repetitive marking.

Yet another object of the present invention is to provide a pivoting rafter square that can lay out 16 and 24 inch center spacing.

Still yet another object of the present invention is to provide a pivoting rafter square that is inexpensive to manufacture and operate.

One more object of the present invention is to provide a pivoting rafter square that is simple and easy to use.

Additional objects of the present invention will appear as the description proceeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

BRIEF DESCRIPTION OF THE DRAWINGS

In order that the invention may be more fully understood, it will now be described, by way of example, with reference to the accompanying drawings in which:

FIG. 9 is a chart of the present invention.

FIG. 10 is a chart of the present invention.

FIG. 11 is a chart of the present invention.

FIG. 12 is a chart of the present invention.

LIST OF REFERENCE NUMERALS

Figure 1:
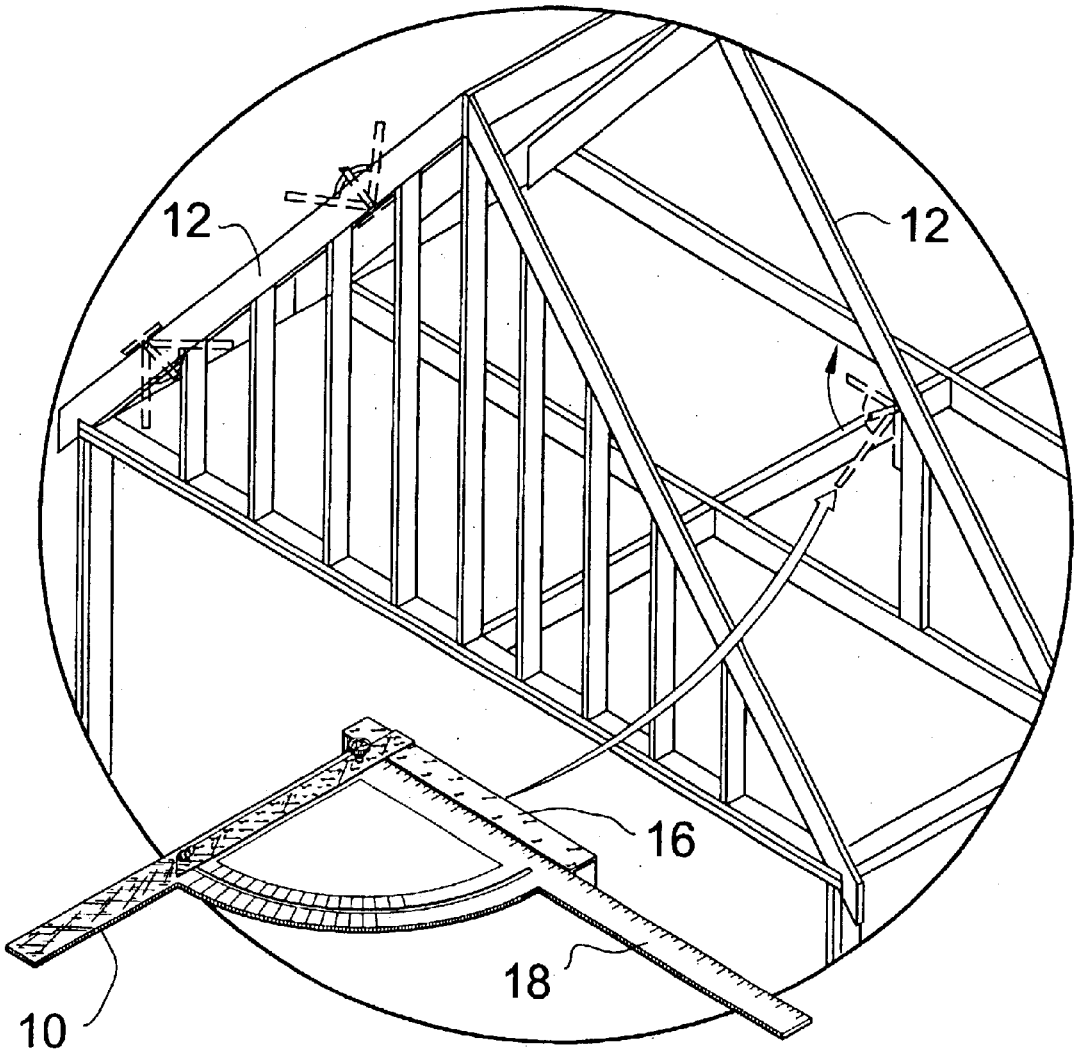
FIG. 1 is an illustrative view of the present invention in use.

With regard to reference numerals used, the following numbering is used throughout the drawings.

10 present invention
12 rafter
14 pivotal indicator arn
16 pivotal indicator guide
18 square portion
20 thumb screw
22 pivot point
24 wing nut
26 track
28 indication markings
30 retainer
32 work piece
34 indicia for plumb cuts
36 indicia for seat cuts
38 ring beaing
40 storage port

42 end cap
44 guide chart

DETAILED DESCRIPTION OF THE PREFERRED EMBODIMENT

The following discussion describes in detail one embodiment of the invention and several variations of that embodiment. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrated view of the present invention 10 in use. The present invention 10, a rafter's square or framing square, is used for laying out angle cuts in rafters 12. The square portion 18 of the square 10 is similar to a conventional square but has a detachable guide 16 similar to a tee square attached to the heel portion of the right angle square. The guide portion 16 of the device 10 can be pressed against a workpiece rafter and can be clamped at any angle with markings on the square for common rafters, hip rafters and degrees. Also provided are standard rafter charts printed on the square and charts for irregular hips and valleys.

Figure 2:
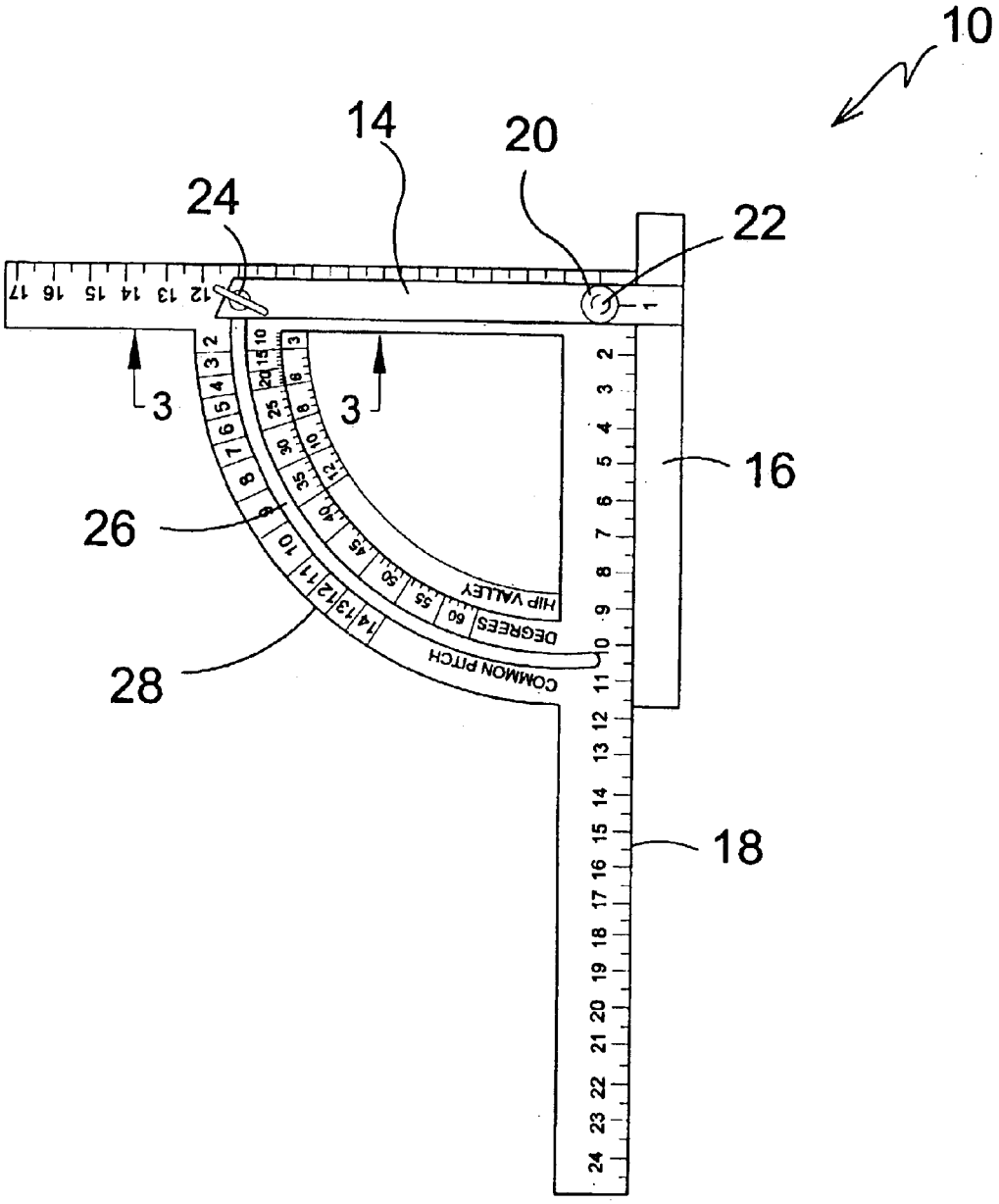
FIG. 2 is a top view of the present invention.

Turning to FIG. 2, shown therein is a top view of the present invention 10. Shown is a top view of the rafter square 18 of the present invention 10 having a pivotal indicator arm 14 and pivotal indicator guide 16. The pivotal arm 14 and guide 16 are detachable from the square portion 18 by unscrewing the thumbscrew 20 that secures the device to its pivotal point 22 located on the heel portion of the right angle square. A wing nut 24 is provided and allows the indicator arm 14 to slide along a track 26 and point to indication markings 28 along the track surface, which markings are for common rafter pitch, hip valley and degrees.

Figure 3:
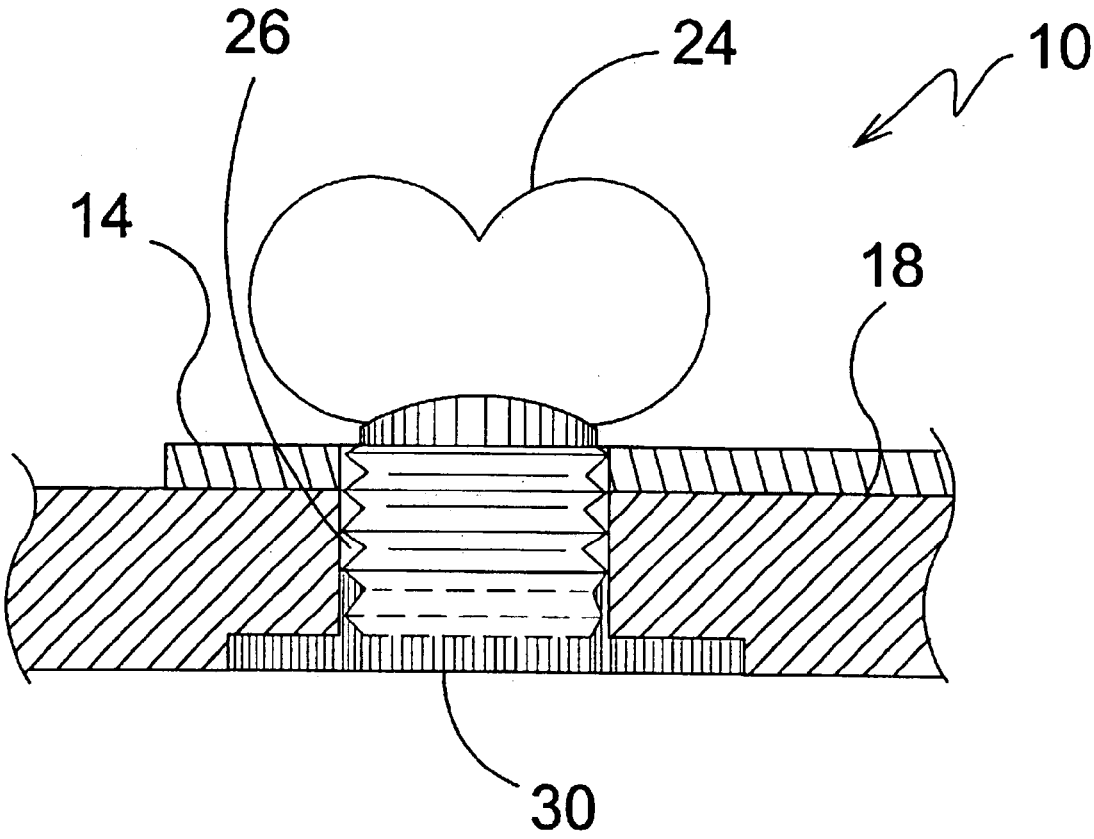
FIG. 3 is a sectional view of the present invention.

Turning to FIG. 3, shown therein is a sectional view of the present invention 10. Shown is a sectional view of the wing nut 24 portion of the device 10 as cut from FIG. 2. The wing nut 24 adjusts to allow the indicator arm 14 to slide along the provided track 26 and point to indication markers provided on the surface portion of the slide. As the pivotal guide is positioned, the pivotal indicator arm 14 moves in response thereto. Also shown is the rafter square portion 18 and a retainer 30 for the wing nut 24.

Figure 4:
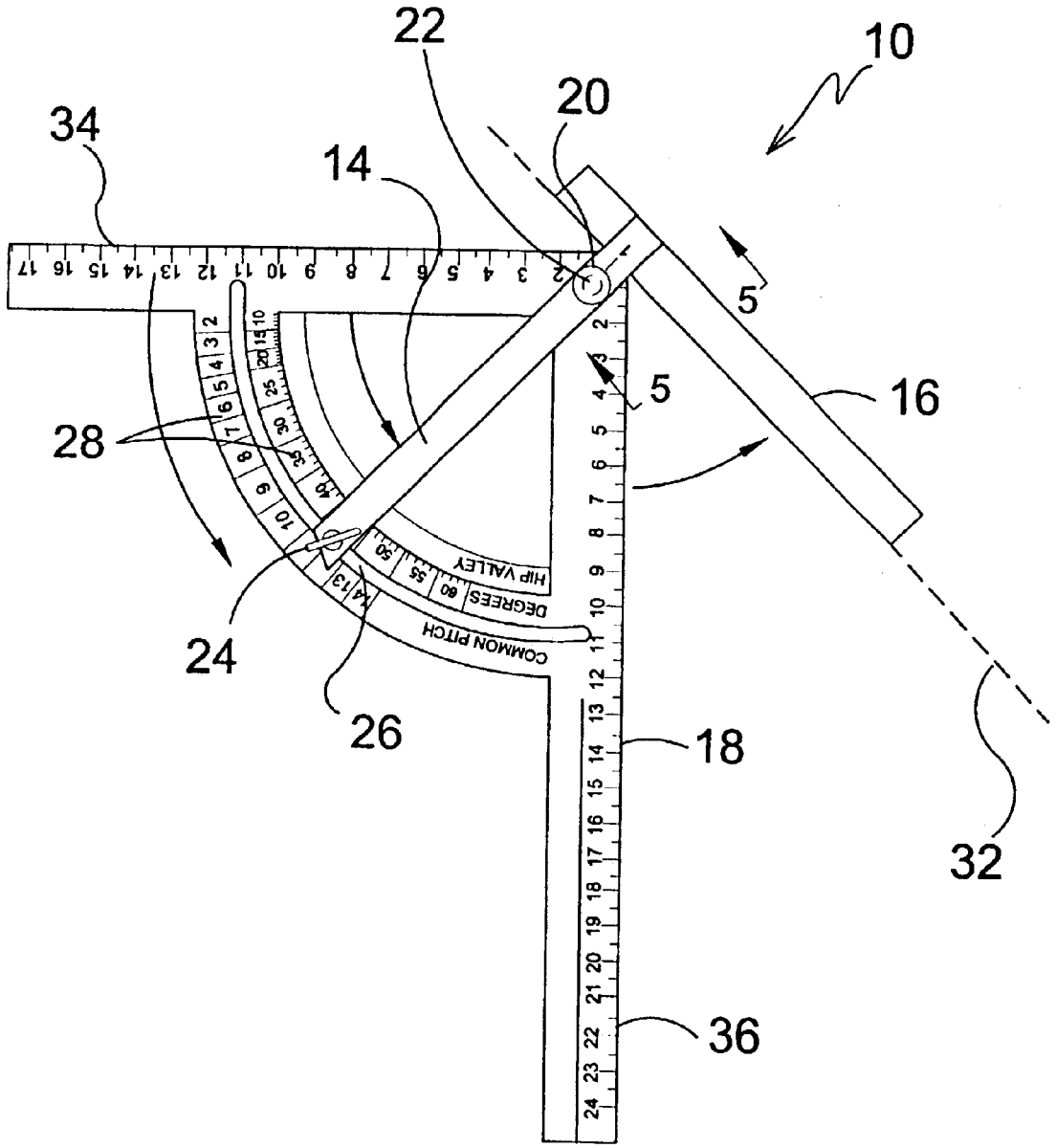
FIG. 4 is a top view of the present invention.

Turning to FIG. 4, shown therein is an exploded perspective view of the present invention 10. Clamping the guide 16 to the desired setting saves time for aligning increments on two separate sides of the square 18 which may occur several times on one work piece 32 for plumb cuts, seat cuts and over hangs. Speed and accuracy is achieved by having the guide 16 press to the work piece 32 and not having to align over material with rounded edges, missing pieces and knots. Also shown are indicia markings 34, 36 on square 18 used for plumb cuts and seat cuts, respectively, thumb screw 20, pivot point 22, indicator arm 14, indicia markings 28, wing nut 24 and track 26.

Figure 5:
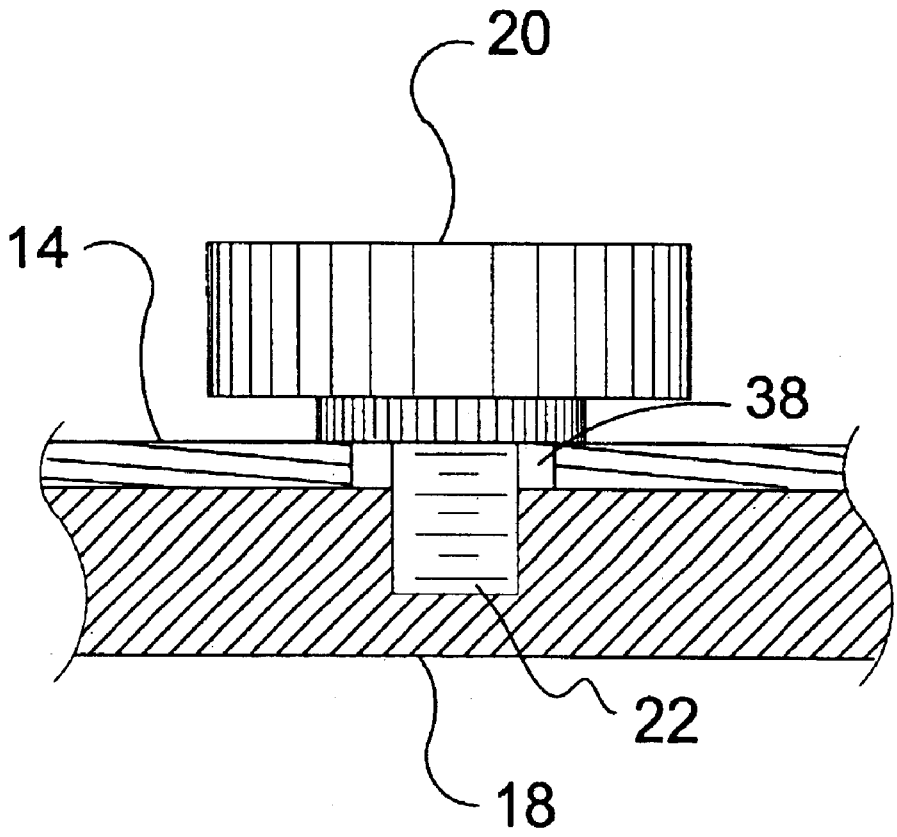
FIG. 5 is a cross sectional view of the present invention.

Turning to FIG. 5, shown therein is a cross sectional view of the locking thumbscrew 20 of the present invention. Shown is a sectional view of the thumbscrew 20 portion of the device as cut from FIG. 4. The thumbscrew 20 secures the pivotal arm 14 and guide to the pivotal point 22 located on the heel portion of the square 18. The indicator arm 14 and guide assembly are removable from the tee square portion 18 by removing the thumbscrew 20 and wing nut which allows the square 18 to be used separately. A ring bearing 38 is also shown. One end of thumbscrew 20 is enlarged for gripping by a user and the other end is threaded into the square 18.

Figure 6:
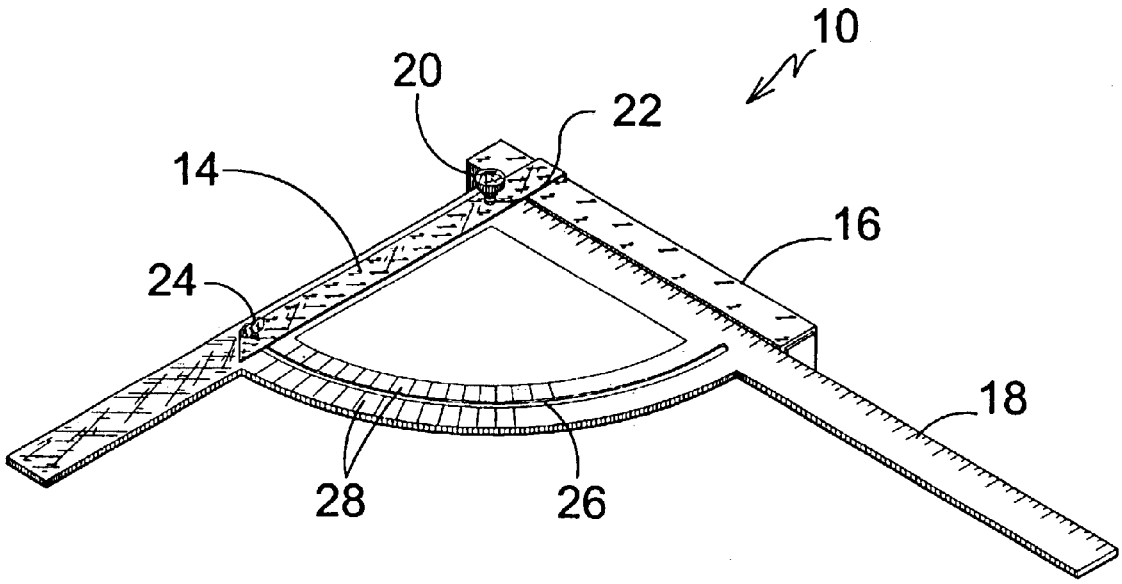
FIG. 6 is a perspective view of the present invention.

Turning to FIG. 6, shown therein is a perspective view of the present invention 10. Shown is a perspective view of the rafter square 18 of the present invention 10 having a pivotal indicator arm 14 and pivotal indicator guide 16. The rafter square 18 has a first and second side or edge perpendicular to each other and may have indicia printed on the top surface thereof on the outer edge of the first and second edges thereof The pivotal arm 14 and guide 16 are detachable from the tee portion by unscrewing the thumbscrew 20 that secures the device to its pivotal point 22 located on the heel portion of the right angle square 18. Pivotal arm 14 is parallel to the second side of square 18 and pivotal guide 16 is parallel to the first side of square 18. A wing nut 24 is provided and allows the pointed end of the indicator arm 14 to slide along a track 26 and point to indication markings 28 along the tracks surface. The curved guide table 28 runs from the inner edge of the first side to the inner edge of the second side of the square 19.

Figure 7:
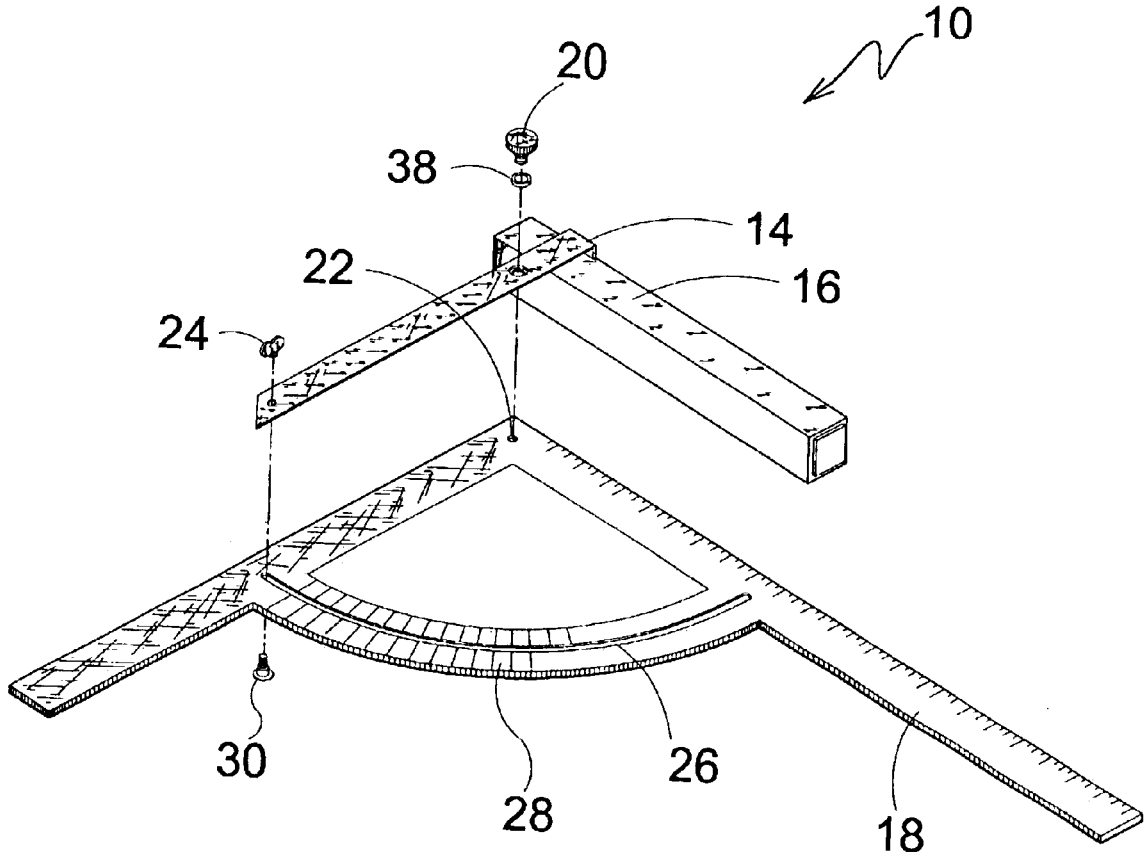
FIG. 7 is an exploded perspective view of the present invention.

Turning to FIG. 7, shown therein is an exploded view of the present invention 10. Shown is an exploded view of the rafter square 18 of the present invention 10 having a pivotal indicator arm 14 and pivotal indicator guide 16. The pivotal arm 14 and guide 16 are detachable from the rafter square portion 18 by unscrewing the thumbscrew 20 that secures the device to its pivotal point 22 located on the heel portion of the right angle square 18. A wing nut 24 is also removed and when in use allows the indicator arm 14 to slide along a track 26 and point to indication markings 28 along the tracks surface. Also shown are a ring bearing 38 and wing nut retainer 30.

Figure 8:
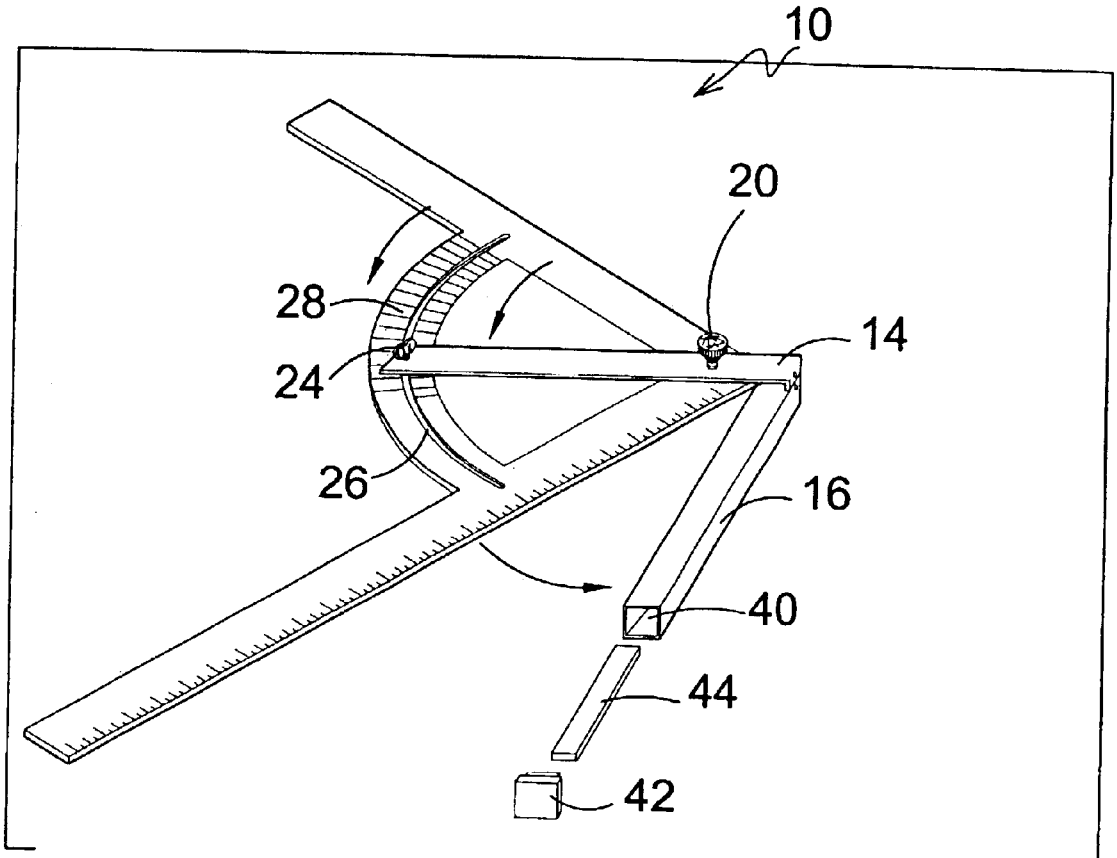
FIG. 8 is a perspective view of the present invention.

Turning to FIG. 8, shown therein is a perspective view of the present invention 10. Located at the distal end of the indicator guide 16 is a storage port 40 with an end cap 42. The storage port 40 opens into an inner cavity which can hold the removed wing nut 24 and thumbscrew 20 when the arm 14 is removed. Within the storage port 14 a guide chart 44 can also be stored and used for reference. Also shown are the track 26 and markings 28.

Turning to FIG. 9, shown therein is a chart for use with the present invention showing the conversion tables for length per foot run.

Turning to FIG. 10, shown therein is a chart for use with the present invention showing the difference in length of jack rafters.

Turning to FIGS. 11 and 12, shown therein is a chart for use with the present invention for calculating the cuts for irregular hip roofs.

What is claimed to be new and desired to be protected by Letters Patent is set forth in the appended claims:

I claim:

1. A framing square, comprising:

a) a framing square having a first edge and a second edge, wherein said first and second edges are perpendicular to each other having a heel portion thereon at the intersection of said first and second edges, wherein said heel portion has an aperture therein, said framing square having a top surface and inner and outer edges thereon, wherein indicia are printed on said outer edge of said top surface of said first and second edges of said framing square;

b) a curved guide table extending from said inner edge of said first edge to said inner edge of said second edge of said framing square, said guide table having a track therein, wherein indicia useful for framing are printed on said guide table;

c) a pivotal guide disposed adjacent and parallel to said outer edge of said first edge of said framing square, said pivotal guide having a first and second end and a top surface;

d) a pivotal arm disposed on said top surface of said pivotal guide, wherein said pivotal arm is perpendicular to said pivotal guide, wherein said pivotal arm is parallel to said second edge of said framing square, said pivotal arm having a first and second end, said first end having a first aperture and said second end having a second aperture therein, said second end of said pivotal arm having a pointed end to permit it to point to appropriate indicia on the guide table;

e) a pivot point disposed on said second end of said pivotal arm at said heel portion of said framing square, wherein said pivot point pivots about said aperture in said heel portion and said first aperture of said pivotal arm to permit the pivotal guide and pivotal arm to pivot on the framing square; and, f) a means for removably attaching said pivotal arm onto said top surface of said framing square whereby the pivotal arm points to the appropriate indicia on the guide table when the pivotal guide is pressed to a workpiece and whereby the pivotal arm and pivotal guide can be removed from the framing square to allow the framing square to be used alone.

2. The framing square of claim 1, further comprising a means for locking said pointed end of said pivotal arm to said track of said curved guide table.

3. The framing square of claim 2, wherein said means for locking said pointed end of said pivotal arm to said track comprises a wing nut extending through said second aperture of said second end of said pivotal arm and through said track to be joined to a retainer on the end of said wing nut.

4. The framing square of claim 3, further comprising a retainer disposed on said wing nut end to permit the wing nut to be removably locked in place.

5. The framing square of claim 4, wherein said means for removably attaching said pivotal arm onto said top surface of said framing square comprises:

a) a thumbscrew, said thumbscrew having a first end and a second end, wherein a said first end is enlarged for being gripped by a user and said second end is threaded to permit attachment to said framing square;

b) wherein said thumbscrew passes through said first aperture in said first end of said pivotal arm and into said aperture in said heel portion of said framing square;

c) wherein said aperture in said heel portion of said framing square is threaded for mating to said second end of said thumbscrew; and, d) a ring bearing disposed between said thumbscrew and said pivotal arm to permit easy movement of the pivotal arm.

6. The framing guide of claim 5, wherein said pivotal guide has an interior cavity therein to permit articles to be stored therein.

7. The framing guide of claim 6, wherein said first end of said pivotal guide has an opening therein, wherein said opening allows entry into said interior cavity of said pivotal guide, said opening further comprising a mating end cap to permit the cavity of the pivotal guide to be closed.

8. The framing guide of claim 7, wherein said indicia printed on said guide table comprise common rafter pitch.

9. The framing guide of claim 8, wherein said indicia printed on said guide table comprise degrees.

10. The framing guide of claim 9, wherein said indicia printed on said guide table comprise hip valley rafter pitch.

11. The framing guide of claim 10, wherein said pivotal guide and said pivotal arm are removable from said framing square to permit the framing square to be used alone.

* * * * *